United States Patent [19]

Jones et al.

[11] 4,456,321

[45] Jun. 26, 1984

[54] TWO-PIECE, PUSH-ON TYPE GROUNDING CLIP

[75] Inventors: Philip N. Jones, Rustburg; Tye C. Drinkard, Forest, both of Va.

[73] Assignee: General Electric Company, Lynchburg, Va.

[21] Appl. No.: 369,550

[22] Filed: Apr. 19, 1982

[51] Int. Cl.[3] ..... H01R 4/24; H01R 4/66

[52] U.S. Cl. ..... 339/97 R; 339/14 L; 339/244 UC

[58] Field of Search ..... 339/14, 95–97, 339/242, 243, 244 UC; 174/84 S, 84 C

[56] References Cited

U.S. PATENT DOCUMENTS

| | | | |
|---|---|---|---|
| 430,400 | 3/1890 | Page | 292/306 |
| 2,685,720 | 8/1954 | Petri | 24/73 |
| 2,968,780 | 1/1961 | Roswell | 339/17 |
| 2,997,685 | 8/1961 | Anderson | 339/149 |
| 3,004,095 | 10/1961 | Buzak | 174/51 |
| 3,019,409 | 1/1962 | Sarafinas | 339/219 |
| 3,122,604 | 2/1964 | Cook et al. | 174/51 |
| 3,320,607 | 5/1967 | Rueger | 340/381 |
| 3,431,544 | 3/1969 | Valle et al. | 339/256 |
| 3,486,158 | 12/1969 | Soltysik et al. | 339/14 |
| 3,526,870 | 9/1970 | Mayala | 339/97 |
| 3,528,050 | 9/1970 | Hindenburg | 339/95 |
| 3,757,268 | 9/1973 | Genovese et al. | 339/14 R |
| 3,829,825 | 8/1979 | Hawkins | 339/242 |
| 4,186,981 | 2/1980 | Holton | 339/14 R |

*Primary Examiner*—Eugene F. Desmond

*Attorney, Agent, or Firm*—Cushman, Darby & Cushman

[57] ABSTRACT

A two-piece, push-on type grounding clip for grounding a conductor (e.g. the shield of a shielded line or cable) to a metallic wall has a first, U-shaped, resilient metal clamp having an open end adapted for engagement with the edge of a metallic wall. The closed end of the first clamp has a transverse groove for receiving the conductor (e.g. a shielded cable). The walls forming the transverse groove are shaped and/or sized to cut the cable insulation (if any) and to form a secure electrical contact with a cable conductor (e.g. the shield of the cable). A second U-shaped resilient clamp has an open end with a transverse groove for receiving both the closed end of the first clamp and the conductor (e.g. shielded cable). The second clamp prevents the cable from backing out of the transverse groove of the first clamp and also exerts additional pressure on the first clamp's engagement with the metallic wall.

15 Claims, 7 Drawing Figures

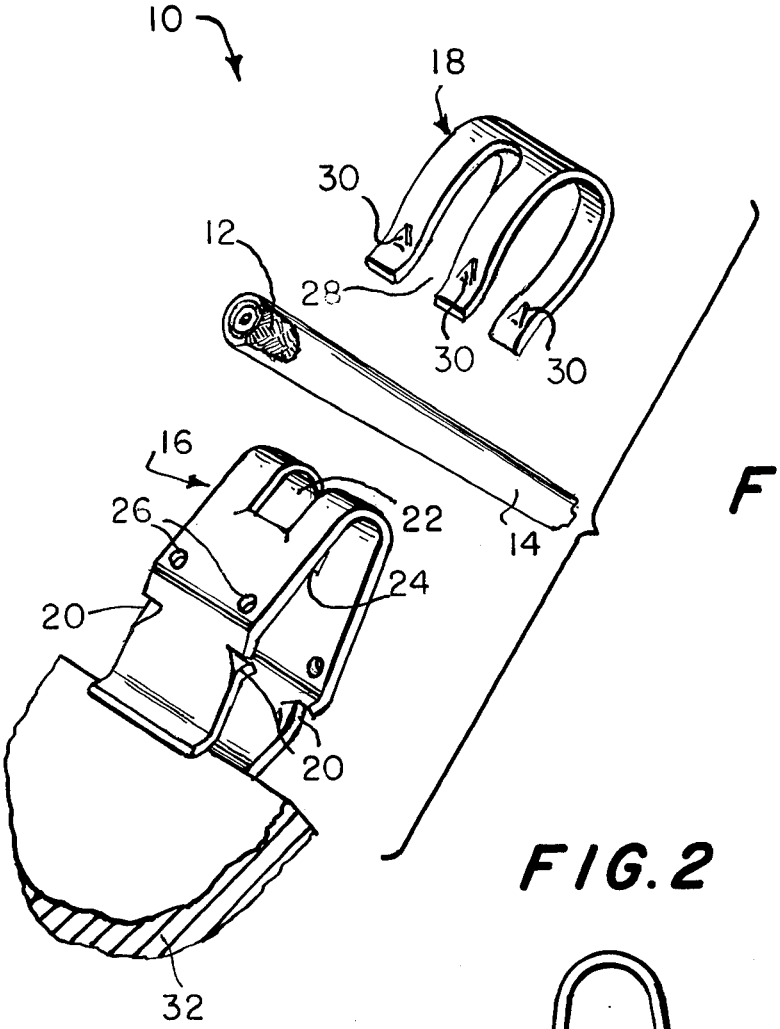
FIG. 1
FIG. 2
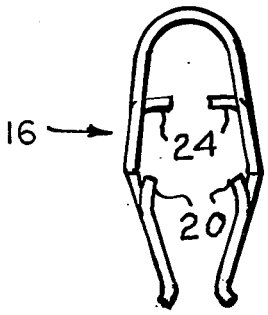
FIG. 3
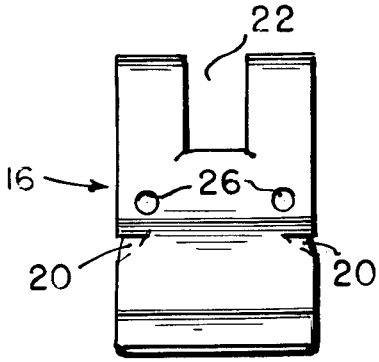
FIG. 4
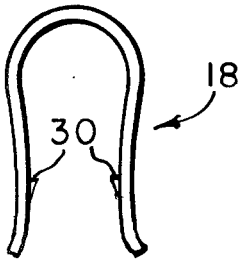
FIG. 5
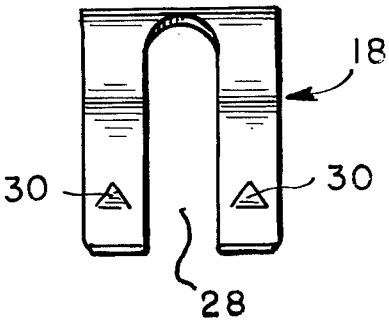

TWO-PIECE, PUSH-ON TYPE GROUNDING CLIP

BACKGROUND OF THE INVENTION

The present invention is related generally to grounding clips and more particularly to push-on type grounding clips.

Electronic modules that are connected by shielded cables must have the shield connected, or grounded, to the module enclosure at the point of entry to prevent spurious signal currents potentially present on the shield from entering or leaving the enclosure and thus mixing undesirably with information carrying signals. Such mixing may seriously degrade the performance of the electronic module as will be appreciated.

There are a wide variety of prior methods for grounding the shield of a shielded cable. One method provides a connector having a terminal designed for receiving the shield of the shielded cable. Another method uses a terminal lug soldered to the shield where the insulation has been removed. This terminal lug is then bolted to the metallic wall of a chassis. Other techniques may have been tried as well. However, such known prior methods are relatively expensive, require specialized hardware, and are often time consuming during assembly of the finished product.

Push-on type grounding clips, such as the present invention, eliminate many of the abovedescribed disadvantages. There are a wide variety of push-on type grounding clips known in the art. For example, U.S. Pat. No. 4,186,981 to Holton is for a one-piece grounding device for holding a wire or the like to an edge of a metallic panel.

U.S. Pat. No. 3,528,050 to Hindenburg is for a one-piece push-on type grounding clip. The grounding clip is generally U-shaped and is provided with a spur which will tend to dig into the surface of the metallic wall to which it is attached.

Another type of one-piece push-on grounding clip is disclosed in U.S. Pat. No. 3,526,870. The grounding clip disclosed therein is provided with a toothed edge for penetrating and displacing the insulating covering of the wire thus making full electrical contact with the shield during installation of the grounding clip.

There are a wide variety of push-on type grounding clips known in the art, the brief description of the above-identified specific patents is provided merely as an exemplary review of such relevant prior art and is not intended to be exhaustive.

SUMMARY OF THE PRESENT INVENTION

The present invention is for a two-piece push-on type grounding clip for grounding, for example, the shield of a shielded cable to a metallic wall. The grounding clip has a first U-shaped resilient metal clamp having an open end adapted for engagement with the edge of the metallic wall. A transverse slot is cut into the closed end of the first U-shaped clamp and is dimensioned to transversely receive the shielded cable. The walls of the transverse slot are sharp enough to cut through any outer insulation of the cable thereby making electrical contact with the shield when the cable is pushed into the slot.

A second U-shaped resilient clamp has a transverse slot cut into its open end which is dimensioned to transversely receive and engage the shielded cable. The open end of the second clamp is adapted for engagement with the closed end of the first clamp. When engaged, the second clamp prevents the shielded cable from backing out of the transverse groove in the open end of the first clamp.

The first clamp is preferably provided with stop tabs which extend inwardly from the bottom of the transverse groove to prevent further engagement of the clamp with the metallic wall. The first clamp is also preferably provided with inwardly extending projections from the open end thereof for securely engaging the metallic wall.

Finally, juxtaposed portions of the first clamp preferably have openings formed therein for receiving congruent projections projecting inwardly from the open end of the second clamp member. When the second clamp is properly positioned, its projections cooperate with the congruent openings of the first clamp to securely maintain the second clamp in the proper position. The second clamp may simultaneously cause the first clamp to exert increased pressure on the metallic wall in addition to preventing the shielded cable from backing out of the transverse groove in the first clamp.

These, and other objects and advantages of the present invention, will be more apparent from the following detailed description of the presently preferred exemplary embodiment.

BRIEF DESCRIPTION OF THE DRAWINGS

FIG. 1 is an exploded perspective view of an exemplary two-piece, push-on type grounding clip constructed according to the present invention;

FIG. 2 is a side view of the first grounding clamp 16 illustrated in FIG. 1;

FIG. 3 is a front view of the first grounding clamp 16 illustrated in FIG. 1;

FIG. 4 is a side view of the second retention clamp 18 illustrated in FIG. 1;

FIG. 5 is a front view of the second retention clamp 18 illustrated in FIG. 1;

DESCRIPTION OF THE PREFERRED EMBODIMENT

Figure 6:
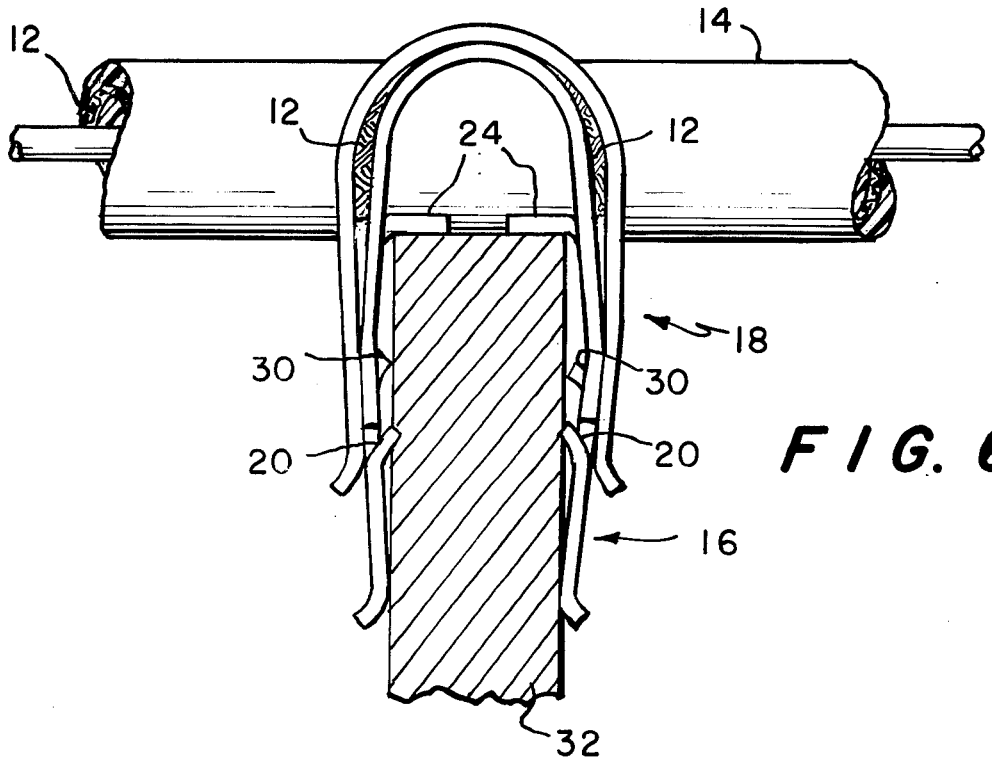
FIG. 6 is a side view illustrating the first grounding clamp 16 and second retention clamp of the FIG. 1 embodiment in operative engagement.

In FIG. 1 a two-piece, push-on type grounding clip 10 is illustrated in an exploded perspective view. The grounding clip 10 is used, for example, for grounding the shield 12 of an insulated, shielded coaxial cable 14. The grounding clip 10 is constructed of a first U-shaped grounding clamp 16 and a second U-shaped retention clamp 18. The grounding clamp 16 is shown in detail in FIGS. 2 and 3 and the retention clamp 18 is shown in detail in FIGS. 4 and 5.

The first or grounding clamp 16 has an open end adapted to be pushed onto the edge 32 of a metallic wall or chassis. The open end is outwardly flared to facilitate easy engagement with the metallic wall. The open end of the grounding clamp 16 is provided with inwardly extending projections or barbs 20 for providing good electrical contact with the metallic wall.

The first grounding clamp 16 also has a closed end with a transverse slot 22 therein. At the bottom of the transverse slot 22 are stop tabs 24 which prevent the forward motion of the grounding clamp 16 relative to the metallic wall and which also define the extent to which cable 14 is inserted into slot 22. The walls of the transverse slot 22 are sufficiently sharp to cut through and displace the outer insulation jacket of the cable 14 thereby providing electrical contact between the grounding clamp 16 and the shielded wire braid 12 of the coaxial cabkle 14. The electrical contact between the shield 12 of the cable 14 and the walls forming the transverse slot 22 is facilitated when the cable 14 is pushed into the transverse slot 22. Accordingly, the grounding clamp 16 is constructed of a good electrical conductor. The grounding clamp 16, in addition to being U-shaped, is constructed as a resilient electrical conductor so as to provide a frictional engagement with the metallic chassis 32.

The first grounding clamp 16 is further provided with four small indentations (or even holes) 26 used in conjunction with the retention clamp 18.

The second or retaining clamp 18 is illustrated in detail in FIGS. 4 and 5. The retaining clamp 18 is also a substantially U-shaped clamp having an open end flared outwardly so as to facilitate engagement with the closed end of the grounding clamp 16. The retention clamp 18 also has a transverse slot 28 through which the cable 14 extends when the retention clamp 18 is inserted over the grounding clamp 16—however the transverse slot 28 is formed in the open end of clamp 18 whereas the slot 22 is formed in the closed end of clamp 16. The open end of the retention clamp 18 has inwardly extending projections 30, (triangular in this embodiment), which cooperate with congruent indentations 26 of the grounding clamp 16 for maintaining the retention clip 18 in the proper position.

The retention clamp 18 is also constructed of a resilient material but it need not be metallic since it does not necessarily form a portion of any grounding circuit. Once the retention clamp 18 is in place, the cable 14 is prevented from backing out of the transverse slot 22 of the grounding clamp 16. Additionally, the resiliency of the retention clamp 18 causes the barbs 20 of the grounding clamp 16 to exert additional pressure on the metallic wall.

Figure 7:
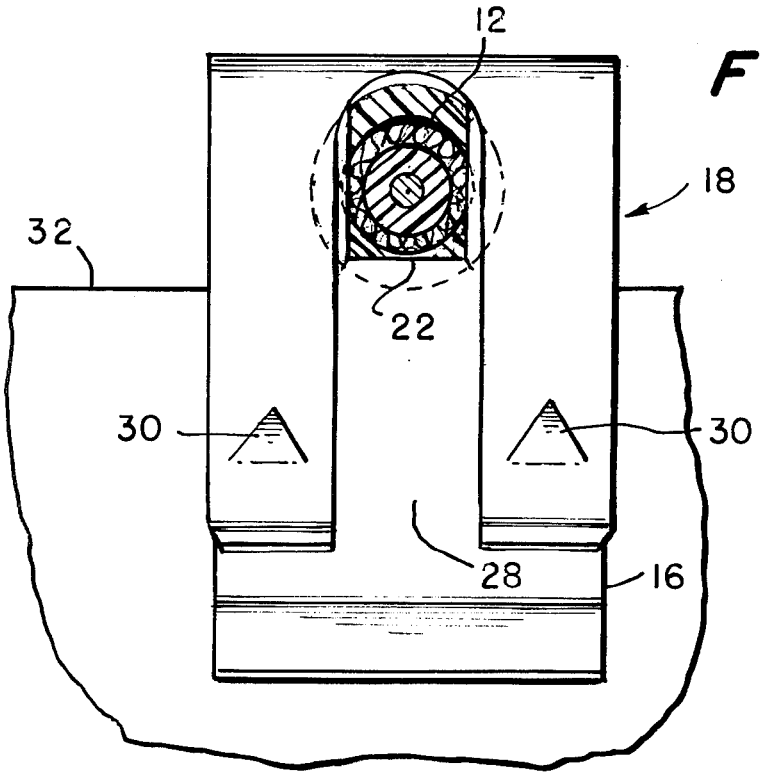
FIG. 7 is a front view illustrating the first grounding clamp 16 and second retention clamp 18 of the FIG. 1 embodiment in operative engagement.

FIGS. 6 and 7 illustrate the grounding clamp 16 and retention clamp 18 in their intended cooperative engagement. The grounding clamp 16 is pushed onto the edge of a metallic wall 32 until the forward motion is stopped by the stop tabs 24 as shown in FIG. 6. The coaxial cable 14 is then inserted into the transverse slot 22 and depressed until it also stops against the stop tabs 24. The transverse slot 22 is dimensioned to separate and displace the outer insulation jacket of the cable 14 thereby facilitating electrical contact between the walls forming the transverse slot 22 and the shield 12 of the cable 14 as shown in FIG. 7. In FIG. 7, the coaxial cable 14 is illustrated in cross section at the point of contact between the shield and the grounding clamp 16. The retention clamp 18 is then pushed onto the closed end of the grounding clamp 16. As shown in FIG. 6, once the inwardly extending projections 30 of the retention clamp 18 make contact with the indentations 26 of the grounding clamp 16, the retention clamp 18 is securely fastened to the grounding clamp 16. This prevents the coaxial cable 14 from backing out of the transverse slot 22. Additionally, the resiliency of the retention clamp 18 supplies additional pressure to insure good electrical contact between the inward extensions or barbs 20 of the grounding clamp 16 and the metallic wall 32. As shown in FIG. 7, the transverse slot 28 of the retention clamp 18 may be dimensioned so as to receive the entire diameter of the coaxial cable 14.

In addition to the above-identified advantages, by not having to remove the insulation from the coaxial cable 14 to facilitate grounding of the shield, assembly time is substantially reduced. Further, both the grounding clamp 16 and the retention clamp 18 may be dimensioned to receive any desired diameter cable. Once the grounding clip 10 is assembled, very little space is occupied which is important in electrical equipment where components are often tightly packed.

Those skilled in the art will recognize that a number of variations and modifications of the preferred embodiment may be made. These embodiments may include, for example, replacing the indentations 26 of the grounding clamp with outwardly extending projections and replacing the inwardly extending projections of the retention clamp with indentations. Additionally, the number and location of stop tabs and inwardly extending projections 20 of the grounding clamp may be varied. Other variations will also be apparent. Thus, the description of the presently preferred exemplary embodiment is only intended to be illustrative.

What is claimed is:

1. A two-piece electrical connection clip for electrically connecting the electrically conductive shield of a shielded electrical cable to a first metallic member, said clip comprising:

a first electrically conductive metallic clamp formed by two members that are joined at a common end, said two members providing a first opening dimensioned to receive and engage therewithin an edge of said first metallic member, said common end having a slot dimensioned to receive and engage therewithin said conductive shield of said shielded electrical cable; and a second clamp dimensioned to engage said first clamp and to securely retain said conductive shield within said second opening.

2. A two-piece clip as in claim 1 wherein said first and second clamps are each integrally formed resilient metallic members.

3. A two-piece clip as in claim 1 or 2 wherein said first clamp includes internally-directed projections for engagement with said first metallic member.

4. A two-piece clip as in claim 3 wherein said second clamp includes internally-directed projections for engagement with said first clamp.

5. A two-piece clip as in claim 4 wherein said first clamp includes indentations on its outer surface for mated engagement with the internally-directed projections of said second clamp.

6. A push-on type grounding clip for grounding a shield of a shielded cable to a metallic wall, said clip comprising:

a first U-shaped resilient electrically conductive clamp adapted for engagement at an open end thereof with the edge of the metallic wall, said first clamp having an open groove in the closed end thereof for receiving the shielded cable with the walls of said groove being dimensioned to contact the shield and thereby ground said shield to said metallic wall; and a second U-shaped, resilient clamp having a groove in an open end thereof dimensioned to receive said cable therewithin, said second clamp being adapted for engagement at its open end with both said closed end of said first clamp and said cable for maintaining said cable in said groove of said first clamp.

7. The clip of claim 6 wherein the first clamp includes stop tabs extending inwardly from the bottom of the groove.

8. The clip of claim 6 wherein the first clamp includes projections extending inwardly from the open end thereof for securely engaging the metallic wall.

9. The clip of claim 6 wherein the resilience of the second clamp, when in place, is such that it causes the first clamp to exert increased pressure on the metallic wall.

10. The clip of claim 6 wherein the first and second clamps are made of metal.

11. The clip of claim 6 wherein juxtaposed portions of the first clamp have openings formed therein and wherein the juxtaposed open ends of the second clamp have inwardly extending projections for cooperating with said openings to allow secure engagement of said second clamp to said first clamp.

12. The clip of claim 6 wherein the juxtaposed open ends of the second clamp are outwardly flared to allow easy engagement of said second clamp with the first clamp.

13. The clip of claim 6 adapted to ground the shield of an insulated cable wherein the walls of the groove in the closed end of the first clamp are sharp enough to cause said walls to cut through any outer cable insulation when pushed thereinto to ground said shield.

14. The clip of claim 6 wherein the juxtaposed open ends of the first clamp are outwardly flared to allow easy engagement of said first clamp with the edge of the metallic wall.

15. The two-piece push-on type electrical connection clip for electrically connecting an electrically conductive cable to a metallic wall, said clip comprising:

a first clamp having (1) a generally U-shaped cross-section with an open end and a closed end, (2) a predetermined width dimension greater than the expected diameter of said cable, (3) the open end being dimensioned to receive and to electrically engage an edge of said metallic wall therewithin, and (4) a transverse slot cut into the closed end along the width thereof and dimensioned to transversely receive and to electrically engage said cable therewithin; and a second clamp having (1) a generally U-shaped cross-section with an open end and a closed end, (2) a predetermined width dimension greater than the expected diameter of said cable, (3) the open end being dimensioned to receive and engage the outer surface of said first clamp therewithin; and (4) a transverse slot cut into the open end along the width thereof and dimensioned to transversely receive and engage said cable therewithin.

* * * * *